US011230877B2

(12) United States Patent
Shin

(10) Patent No.: US 11,230,877 B2
(45) Date of Patent: Jan. 25, 2022

(54) DOUBLE-PANE WINDOW INSULATING SYSTEM

(71) Applicant: Jae Seung Shin, Anyang-si (KR)

(72) Inventor: Jae Seung Shin, Anyang-si (KR)

( * ) Notice: Subject to any disclaimer, the term of this patent is extended or adjusted under 35 U.S.C. 154(b) by 160 days.

(21) Appl. No.: 16/653,150

(22) Filed: Oct. 15, 2019

(65) Prior Publication Data

US 2020/0040646 A1 Feb. 6, 2020

Related U.S. Application Data

(63) Continuation of application No. PCT/KR2018/006530, filed on Jun. 8, 2018.

(30) Foreign Application Priority Data

Jun. 16, 2017 (KR) ..... 10-2017-0076525

(51) Int. Cl.

| | |
|---|---|
| ***E06B 3/67*** | (2006.01) |
| *E06B 3/66* | (2006.01) |
| *E06B 3/673* | (2006.01) |

(52) U.S. Cl.

CPC ..... *E06B 3/67* (2013.01); *E06B 3/6707* (2013.01); *E06B 3/6722* (2013.01); *E06B 3/66* (2013.01); *E06B 3/673* (2013.01); *E06B 3/67365* (2013.01)

(58) Field of Classification Search

CPC ..... E06B 3/67; E06B 3/6707; E06B 3/6722; E06B 3/66; E06B 3/673; E06B 3/37365; E06B 9/24; E06B 3/67365

See application file for complete search history.

(56) References Cited

U.S. PATENT DOCUMENTS

| | | | | |
|---|---|---|---|---|
| 3,903,665 A * | 9/1975 | Harrison | ..... | F24S 10/00 52/171.3 |
| 9,151,105 B1 | 10/2015 | Schwalbe | | |
| 10,781,628 B2 * | 9/2020 | Shin | ..... | E06B 3/677 |

FOREIGN PATENT DOCUMENTS

| | | | |
|---|---|---|---|
| EP | 3 498 962 | A1 | 6/2019 |
| JP | S48-024196 | B1 | 7/1973 |
| JP | S63-258318 | A | 10/1988 |
| JP | H07-189561 | A | 7/1995 |
| JP | 2001-253544 | A | 9/2001 |
| JP | 2007-078254 | A | 3/2007 |
| JP | 2013-112456 | A | 6/2013 |
| JP | 2013-203485 | A | 10/2013 |

(Continued)

OTHER PUBLICATIONS

WO 2018/030638 (Year: 2018).*

(Continued)

*Primary Examiner* — Donald J Loney

(74) *Attorney, Agent, or Firm* — Studebaker & Brackett PC

(57) ABSTRACT

The present invention relates to a double-pane window insulating system. The double-pane window insulating system according to the present invention comprises: a double-pane window having a chamber formed between a pair of windowpanes, a bead inlet via which a plurality of beads and air flow into the chamber, a bead outlet via which the plurality of beads and the air accommodated in the chamber are discharged, and an air entrance/exit opening via which air enters and exits the chamber; and a bead discharge means for discharging the plurality of beads, accommodated in the chamber, to the bead outlet.

18 Claims, 7 Drawing Sheets

(56) References Cited

FOREIGN PATENT DOCUMENTS

| | | | |
|---|---|---|---|
| KR | 20-1995-0022955 | U | 8/1995 |
| KR | 10-2003-0013032 | A | 2/2003 |
| KR | 10-1727572 | B1 | 4/2017 |
| WO | 2016/046539 | A2 | 3/2016 |

OTHER PUBLICATIONS

Machine translation of WO 2018/030638. (Year: 2018).*
International Search Report issued in PCT/KR2018/006530; dated Aug. 31, 2018.
The extended European search report issued by the European Patent Office dated Apr. 17, 2020, which corresponds to European Patent Application No. 18816993.2-1005 and is related to U.S. Appl. No. 16/653,150.
An Office Action; "Notice of Reasons for Refusal", mailed by the Japanese Patent Office dated Oct. 6, 2020, which corresponds to Japanese Patent Application No. 2020-506700 and is related to U.S. Appl. No. 16/653,150.

* cited by examiner

【FIG. 1】
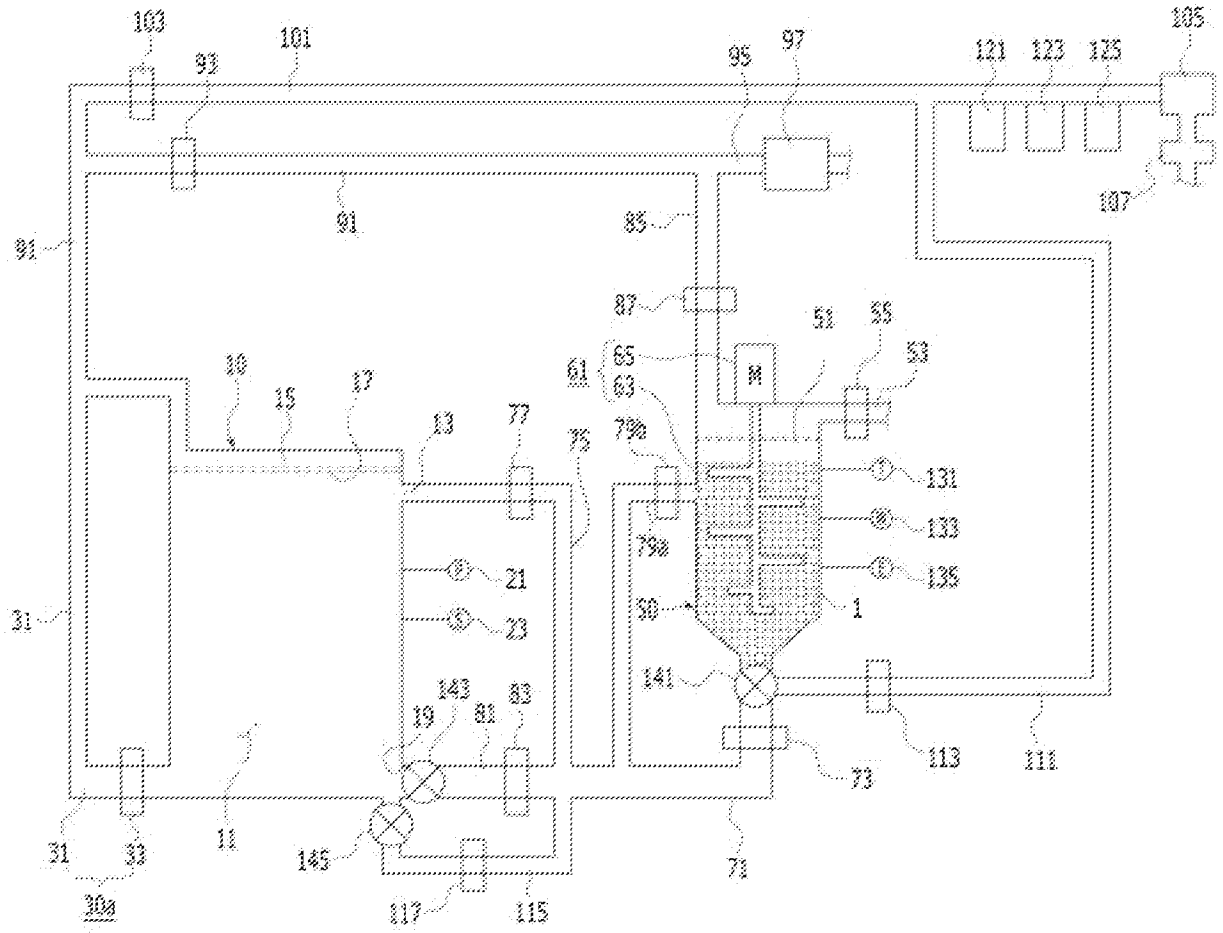

【FIG. 2】
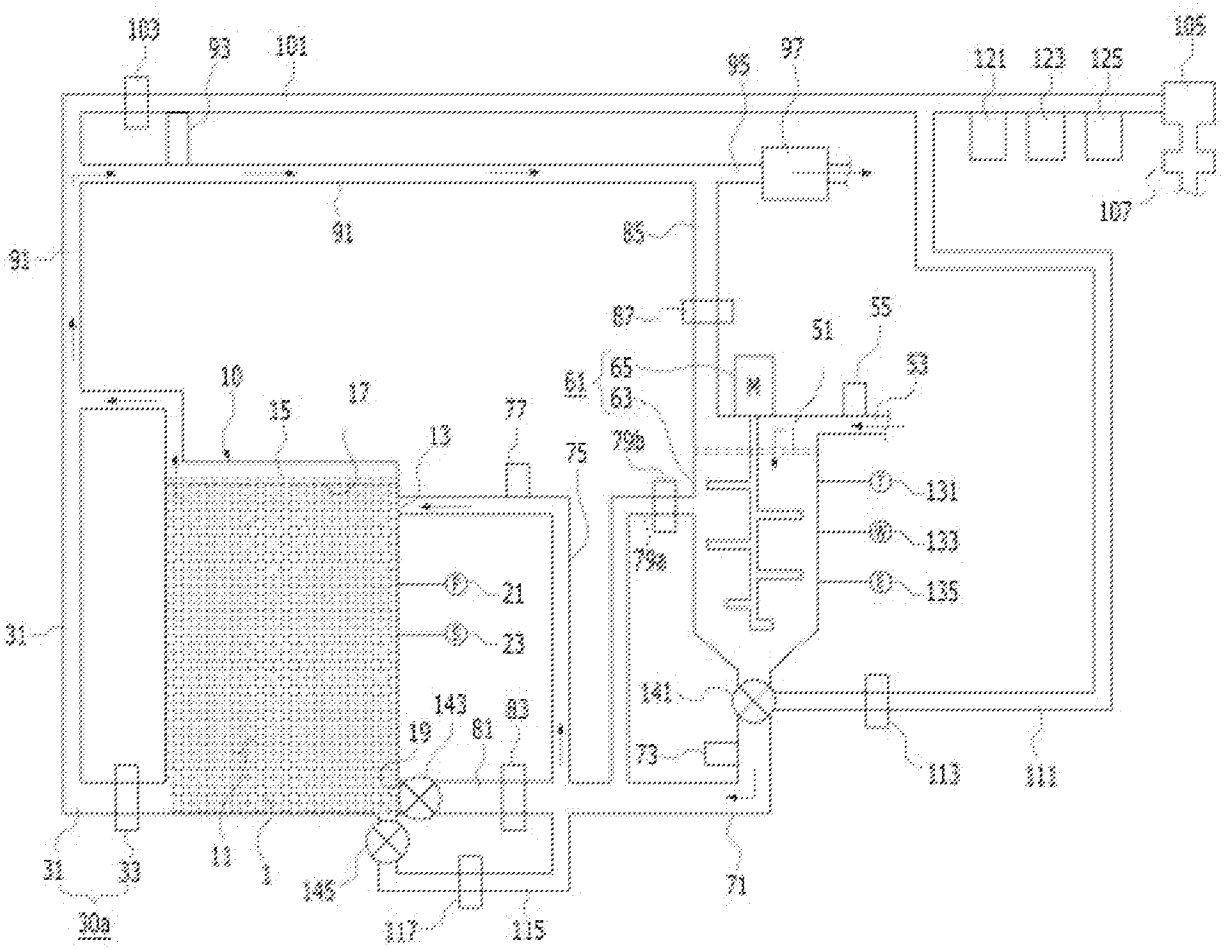

【FIG. 3】
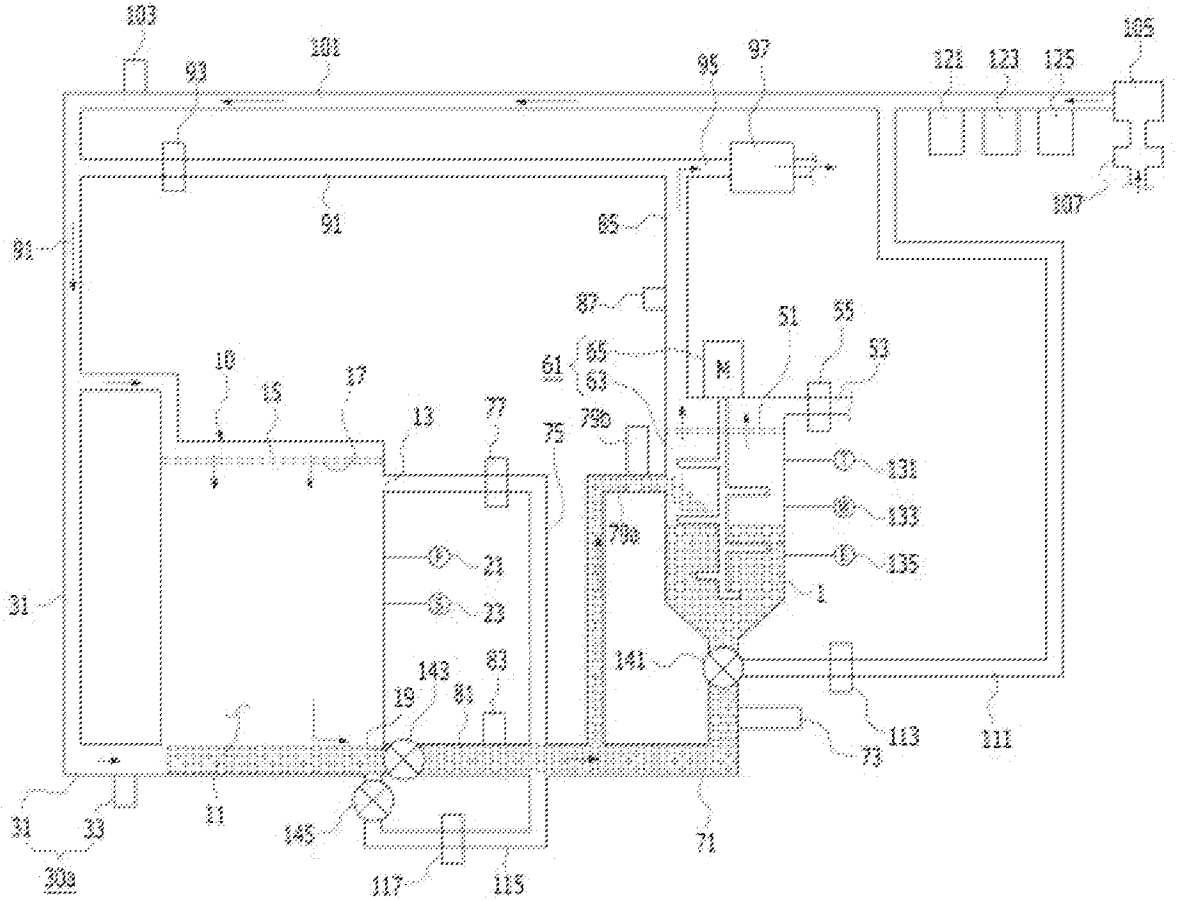

【FIG. 4】
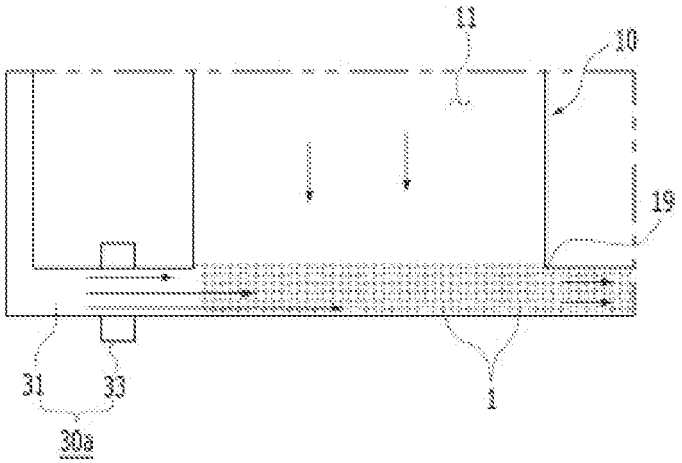
【FIG. 5】
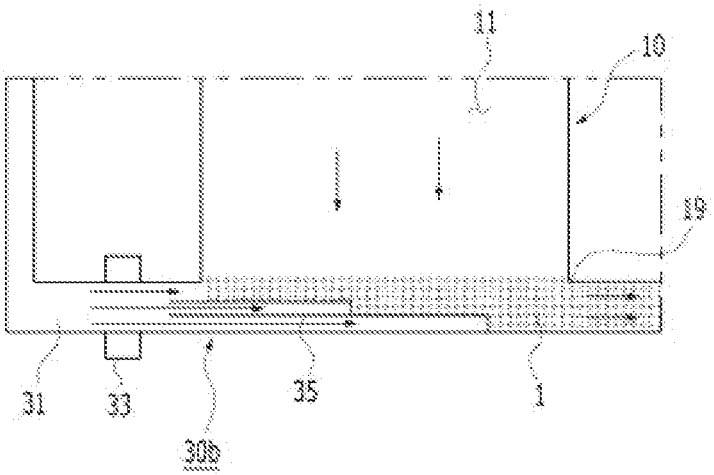

【FIG. 6】
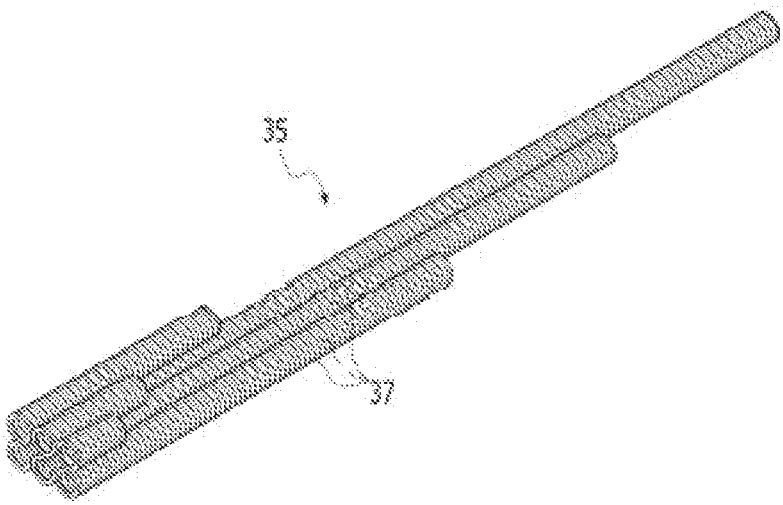
【FIG. 7】
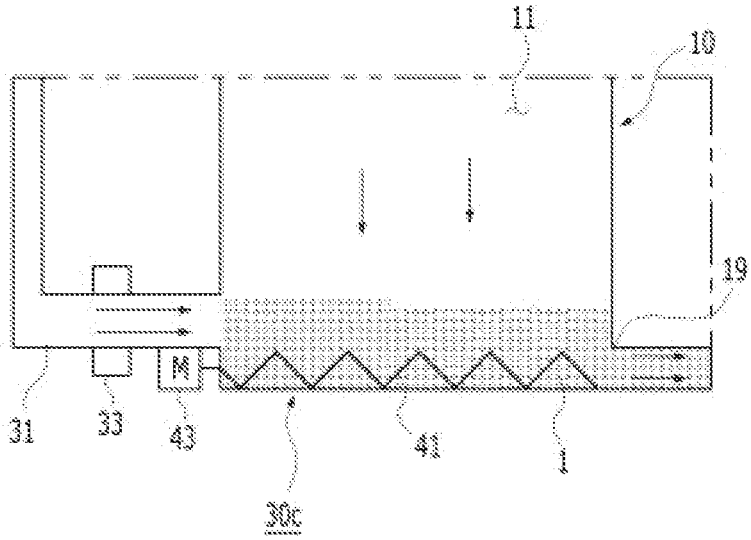

【FIG. 8】
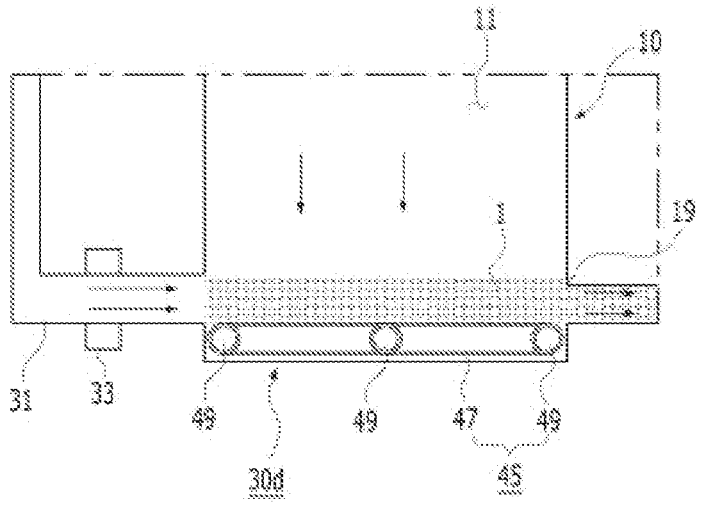
【FIG. 9】
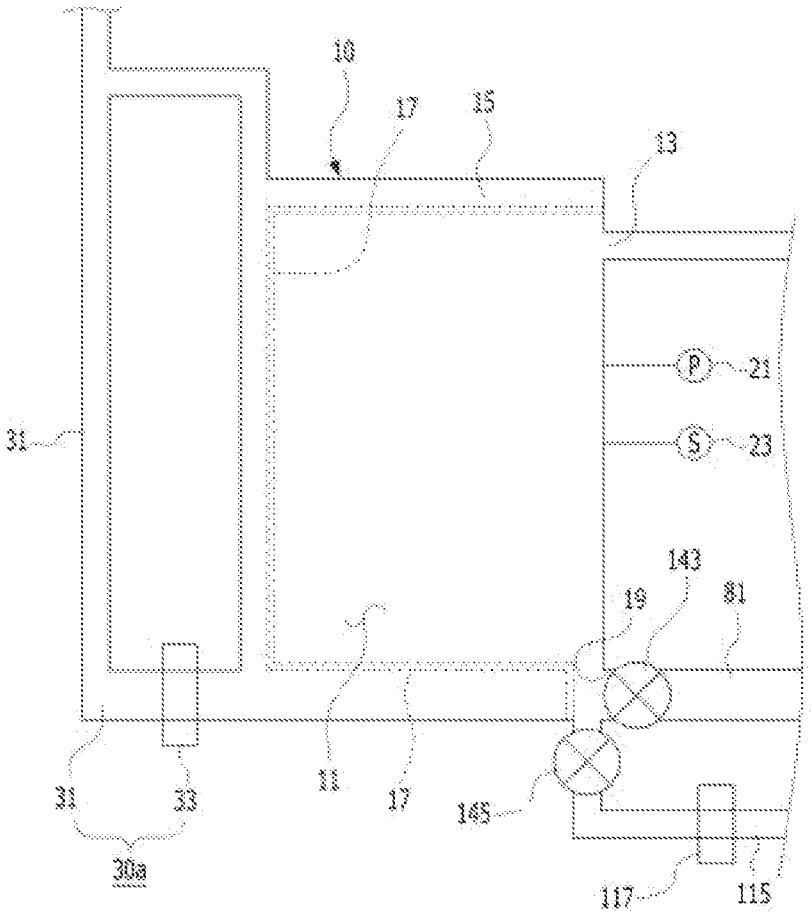

【FIG. 10】
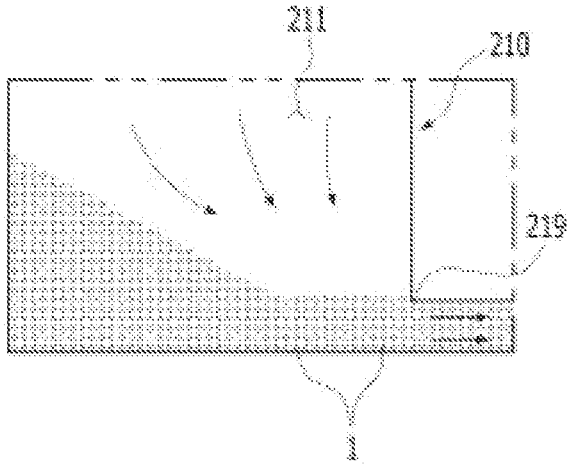

DOUBLE-PANE WINDOW INSULATING SYSTEM

TECHNICAL FIELD

Embodiments of the inventive concept described herein relate to a double-pane window insulating system that fills a chamber between a pair of windowpanes with a plurality of beads to perform heat-insulating, light-blocking, and soundproof functions through the pair of windowpanes or discharges the plurality of beads received in the chamber to enable a view of the outside through the pair of windowpanes, and more particularly, relate to a double-pane window insulating system that reduces residual beads in a chamber at the same time as rapidly discharging beads received in the chamber.

BACKGROUND

In a building, a window is an essential component that isolates an indoor environment from a natural environment, serves as a supply passage for sunlight and fresh outside air, and gives a person a sense of view and a sense of openness.

In recent years, the size of a window and/or a door tends to become larger to make the appearance of a building appealing.

Accordingly, it is important to necessarily minimize heat loss through the window to save energy used in the building.

To solve this problem, a gas-filled double-pane window having gas with a low thermal conductivity in an inner space thereof (e.g., a chamber), a vacuum glass window, low-emissivity coating glass, transmittance adjustment glass, multi-layer glass, and the like have been developed in the related art. However, due to the use of special materials, special manufacturing technologies are required, which increases the manufacturing costs. Therefore, these double-pane windows are difficult to use universally.

Furthermore, although heat-insulating effects are obtained by the various double-pane windows in the related art, separate curtains or blinds for preventing inflow of solar heat have to be additionally installed.

To solve this problem, a double-pane window insulating system that fills a chamber between a pair of windowpanes with a plurality of beads using a blowing device to perform heat-insulating, light-blocking, and soundproof functions through the pair of windowpanes or discharges the plurality of beads in the chamber to enable a view of the outside through the pair of windowpanes is being developed.

However, as illustrated in FIG. 10, the double-pane window insulating system using the plurality of beads has a problem in that when a plurality of beads 1 received in a chamber 211 of a double-pane window 210 are discharged into a reservoir (not illustrated) through a bead outlet 219 located in a bottom area of the chamber 211 by a blowing device (not illustrated), only the beads 1 around the bead outlet 219 are effectively discharged through the bead outlet 219 by a fluid flow generated in the chamber 211, and the beads 1 located on a bottom area on the opposite side to the bead outlet 219 of the chamber 211 stagnate while being obliquely stacked on the opposite side to the bead outlet 219 of the chamber 211 at a critical angle so that the plurality of beads 1 always remain on one side of the bottom area of the chamber 211.

Accordingly, due to the residual beads, the windowpanes cannot be kept clean, and it is difficult to implement a clear view through the windowpanes.

Furthermore, the double-pane window insulating system using the plurality of beads in the related art has the following problems: as the beads flow between the chamber and the reservoir, the beads agglomerate together by static electricity generated between the beads and stagnate to cause a bottleneck phenomenon without being effectively discharged from the chamber or the reservoir; in particular, residual beads in the chamber increase to disable the windowpanes from being kept clean and therefore reduce user convenience; and the power consumption of the blowing device is also increased so that the performance of the entire system is degraded.

PRIOR ART DOCUMENT

Patent Document (Patent document 0001) Korean Patent Publication No. 10-2003-0013032 (Title of Invention: a double-pane window insulating system using the beads, Pub. Date: Feb. 14, 2003)

(Patent document 0002) U.S. Pat. No. 9,151,105 (Title of Invention: WINDOW INSULATION SYSTEM AND METHOD OF OPERATING THE SAME, Date of Patent: Oct. 6, 2015)

(Patent document 0003) Japanese Patent Publication No. 1995-189561 (Title of Invention: a insulation window, Pub. Date: Jul. 28, 1995)

DISCLOSURE

Technical Task

Embodiments of the inventive concept provide a double-pane window insulating system for rapidly discharging beads received in a chamber without stagnation and reducing residual beads in the chamber.

Embodiments of the inventive concept provide a double-pane window insulating system for minimizing static electricity generated between beads, thereby enabling the beads to be effectively discharged from a chamber or a reservoir and thus preventing a bottleneck phenomenon, enabling windowpanes to be kept clean and thus improving user convenience, and enabling a reduction in the power consumption of a blowing device and thus improving the performance of the entire system.

Technical Solution

According to an exemplary embodiment, a double-pane window insulating system includes a double-pane window including a chamber formed between a pair of windowpanes, a bead inlet through which a plurality of beads and air are introduced into the chamber, a bead outlet through which the plurality of beads and the air received in the chamber are discharged, and an air entrance/exit opening through which air enters or exits the chamber, and a bead discharge means that discharges the plurality of beads received in the chamber to the bead outlet.

The bead discharge means may include a chamber air inflow pipe that is provided on the opposite side to the bead outlet so as to connect to the chamber and that introduces air into the chamber and a chamber air inflow pipe valve that is provided in the chamber air inflow pipe and that opens or closes the chamber air inflow pipe.

The bead discharge means may further include an air injection member that is provided on the bottom of the chamber or in the chamber air inflow pipe and that injects air flowing through the chamber air inflow pipe toward the bead outlet, in which the air injection member includes a plurality of pipes that have different lengths and that are stacked one above another.

The bead discharge means may include a rotatable screw shaft having a helical shape and provided on the bottom of the chamber so as to be directed toward the bead outlet and a screw shaft drive motor that rotates the screw shaft.

The bead discharge means may include a belt conveyor that is provided on the bottom of the chamber to form a caterpillar and that discharges the plurality of beads received in the chamber toward the bead outlet.

The double-pane window insulating system may include a reservoir that stores the plurality of beads and a main blowing device that suctions air in the chamber or forces air into the chamber to fill the chamber with the plurality of beads stored in the reservoir or discharge the plurality of beads received in the chamber into the reservoir.

The double-pane window insulating system may include a bead flow pipe that is connected to the reservoir and that guides a flow of the plurality of beads, a bead supply pipe branching off from the bead flow pipe and connected to the bead inlet, a bead discharge pipe branching off from the bead flow pipe and connected to the bead outlet, an air discharge pipe that is connected to the reservoir and that guides a flow of air discharged from the reservoir, an air flow pipe that is connected to the air entrance/exit opening and that guides a flow of air that enters or exits the air entrance/exit opening, and a connection pipe that connects to the air flow pipe and the air discharge pipe, in which the main blowing device is provided on the connection pipe.

The double-pane window insulating system may further include a branch pipe that branches off from the air flow pipe and guides a flow of air, a branch pipe valve that is provided in the branch pipe and that opens or closes the branch pipe, and an auxiliary blowing device that is provided on the branch pipe and that forces air into the chamber through the branch pipe and the air flow pipe.

The chamber air inflow pipe may branch off from the air flow pipe or the branch pipe.

The double-pane window insulating system may include a bead flow pipe valve that is provided in the bead flow pipe and that opens or closes the bead flow pipe, a bead supply pipe valve that is provided in the bead supply pipe and that opens or closes the bead supply pipe, a bead discharge pipe valve that is provided in the bead discharge pipe and that opens or closes the bead discharge pipe, an air discharge pipe valve that is provided in the air discharge pipe and that opens or closes the air discharge pipe, and an air flow pipe valve that is provided in the air flow pipe and that opens or closes the air flow pipe. The bead flow pipe valve and the bead supply pipe valve may be opened and the bead discharge pipe valve may be closed when the chamber is filled with the plurality of beads from the reservoir, and the bead flow pipe valve and the bead discharge pipe valve may be opened and the bead supply pipe valve may be closed when the plurality of beads are discharged from the chamber into the reservoir.

The double-pane window insulating system may further include a bead recovery pipe that branches off from the bead supply pipe or the bead flow pipe and that is connected to the reservoir and a bead recovery pipe valve that is provided in the bead recovery pipe and that opens or closes the bead recovery pipe. The bead recovery pipe valve may be closed when the chamber is filled with the plurality of beads from the reservoir, and the bead recovery pipe valve may be opened when the plurality of beads are discharged from the chamber into the reservoir.

The double-pane window insulating system may further include an auxiliary air flow pipe that is connected to the bead flow pipe or a lower end of the reservoir from the branch pipe and that guides air blown by the auxiliary blowing device into the bead flow pipe or the lower end of the reservoir and an auxiliary air flow pipe valve that is provided in the auxiliary air flow pipe and that opens or closes the auxiliary air flow pipe.

The double-pane window insulating system may further include an auxiliary bead discharge pipe through which the plurality of beads discharged from the chamber into the reservoir flow, the auxiliary bead discharge pipe connecting the chamber and the bead flow pipe and an auxiliary bead discharge pipe valve that is provided in the auxiliary bead discharge pipe and that opens or closes the auxiliary bead discharge pipe.

The double-pane window insulating system may further include an ion generator that is provided on the branch pipe and that ionizes air flowing through the branch pipe, a temperature controller that is provided on the branch pipe and that controls temperature of the air flowing through the branch pipe, and a humidity controller that is provided on the branch pipe and that controls humidity of the air flowing through the branch pipe.

The double-pane window insulating system may further include an agitator that is provided in the reservoir and that stirs the plurality of beads received in the reservoir.

The double-pane window insulating system may further include a temperature measurement sensor that measures temperature in the reservoir, a humidity measurement sensor that measures humidity in the reservoir, and a static-electricity measurement sensor that measures static electricity between the plurality of beads received in the reservoir.

The double-pane window insulating system may further include a bead blocking member for the chamber, the bead blocking member being provided in the chamber to allow only air to enter or exit the chamber. The bead blocking member for the chamber may be provided in the chamber in a cross-sectional shape of "|" that is vertically arranged on the opposite side to the bead inlet and the bead outlet, in a cross-sectional shape of "]" that is vertically arranged on the opposite side to the bead inlet and the bead outlet and is horizontally arranged on an upper side of the chamber, in a cross-sectional shape of "⌊" that is vertically arranged on the opposite side to the bead inlet and the bead outlet and is horizontally arranged on a lower side of the chamber, or in a cross-sectional shape of "⊂" that is vertically arranged on the opposite side to the bead inlet and the bead outlet and is horizontally arranged on the upper and lower sides of the chamber.

The double-pane window insulating system may further include a rotary feeder for the reservoir that is provided in a lower end portion of the reservoir, a rotary feeder for the bead discharge pipe that is provided in a portion where the bead discharge pipe is connected to the bead outlet, and a rotary feeder for the auxiliary bead discharge pipe that is provided in a portion where the auxiliary bead discharge pipe is connected to the bottom of the chamber.

Technical Effect

According to the inventive concept, the double-pane window insulating systems may rapidly discharge beads received in the chamber without stagnation and may reduce residual beads in the chamber. In addition, the double-pane window insulating systems may minimize static electricity generated between the beads, thereby enabling the beads to be effectively discharged from the chamber or the reservoir and thus preventing a bottleneck phenomenon, enabling the windowpanes to be kept clean and thus improving user convenience, and enabling a reduction in the power consumptions of the blowing devices and thus improving the performance of the entire system.

BRIEF DESCRIPTION OF THE FIGURES

FIG. 1 is a view illustrating a configuration of a double-pane window insulating system according to an embodiment of the inventive concept;

FIG. 2 is a view illustrating a process in which a double-pane window of the double-pane window insulating system of FIG. 1 is filled with a plurality of beads;

FIG. 3 is a view illustrating a process in which the plurality of beads are discharged from the double-pane window of the double-pane window insulating system of FIG. 1;

FIG. 4 is an enlarged view of major parts illustrating operation of a bead discharge means of FIG. 3;

FIG. 5 is a view illustrating a configuration of a bead discharge means according to another embodiment;

FIG. 6 is a perspective view of an air injection member of FIG. 5;

FIG. 7 is a view illustrating a configuration of a bead discharge means according to another embodiment;

FIG. 8 is a view illustrating a configuration of a bead discharge means according to another embodiment:

FIG. 9 is a view illustrating a configuration of a double-pane window of a double-pane window insulating system according to another embodiment of the inventive concept; and FIG. 10 is an enlarged view of major parts illustrating a process of discharging beads from a chamber of a double-pane window in the related art.

DETAILED DESCRIPTION

The above and other aspects, features, and advantages of the inventive concept will become apparent from the following description of embodiments given in conjunction with the accompanying drawings. However, the inventive concept is not limited to the embodiments disclosed herein and may be implemented in various different forms. Herein, the embodiments are provided to provide complete disclosure of the inventive concept and to provide thorough understanding of the inventive concept to those skilled in the art to which the inventive concept pertains.

Terms used herein are only for description of embodiments and are not intended to limit the inventive concept. As used herein, the singular forms are intended to include the plural forms as well, unless context clearly indicates otherwise. It will be further understood that the terms "comprise" and/or "comprising" specify the presence of stated features, components, and/or operations, but do not preclude the presence or addition of one or more other features, components, and/or operations. In addition, identical numerals will denote identical components throughout the specification, and the meaning of "and/or" includes each mentioned item and every combination of mentioned items. It will be understood that, although the terms first, second, etc. may be used herein to describe various components, these components should not be limited by these terms. These terms are only used to distinguish one component from another component. Thus, a first component discussed below could be termed a second component without departing from the teachings of the inventive concept.

Unless otherwise defined, all terms (including technical and scientific terms) used herein have the same meaning as commonly understood by those skilled in the art to which the inventive concept pertains. It will be further understood that terms, such as those defined in commonly used dictionaries, should not be interpreted in an idealized or overly formal sense unless expressly so defined herein.

Hereinafter, the inventive concept will be described in detail with reference to the accompanying drawings.

Prior to description of the inventive concept, it should be noted that although a double-pane window insulating system according to an embodiment of the inventive concept is described as being applied to one double-pane window, the spirit and scope of the inventive concept is also applicable to a plurality of double-pane windows.

Furthermore, it should be noted that identical components having the same configurations in various embodiments are denoted by identical reference numerals and representatively described in an embodiment and only components different from those in the embodiment are described in the other embodiments.

FIGS. 1 to 3 illustrate the double-pane window insulating system according to the embodiment of the inventive concept.

As illustrated in the drawings, the double-pane window insulating system according to the embodiment of the inventive concept includes a double-pane window 10 and a bead discharge means 30*a*.

The double-pane window 10 has a structure in which a pair of windowpanes are arranged parallel to each other with a predetermined gap therebetween and supported on a window frame (not illustrated).

An interior space, for example, a chamber 11 is formed between the pair of windowpanes. The chamber 11 has a filling state in which the chamber 11 is filled with a plurality of beads 1 or a discharge state in which the chamber 11 does not receive the plurality of beads 1 therein. The double-pane window 10 performs heat-insulating, light-blocking, and soundproof functions when the chamber 11 is filled with the plurality of beads 1, and the double-pane window 10 lets in light when the plurality of beads 1 are discharged from the chamber 11.

Here, a brief description of the plurality of beads 1 will be given. The beads 1 are small spherical pieces and are filled with air and gas to have a heat insulation property. The beads 1 are preferably made of expanded Styrofoam with excellent fluidity by air-blowing. However, the material of the beads 1 is not limited thereto, and a different type of expanded foam or hydrogel may be used. Furthermore, the beads 1 are preferably white in color to block sunlight or transparent in color to transmit sunlight. In the summer, the beads 1 white in color may be used to obtain a heat insulation effect while blocking sunlight, and in the winter, the beads 1 made of a white or transparent material may be used to provide what is called a bubble wrap effect, thereby ensuring transparency of glass to enable a view of the outside and obtaining a heat insulation effect. Meanwhile, the color of the beads 1 is not limited, and the beads 1 may be manufactured in various colors. Further, the beads 1 may have various cross-sectional shapes such as an oval shape, a polygonal shape, and the like, in addition to the spherical shape.

Meanwhile, a lower end portion and an upper end portion of the double-pane window 10 are open to connect with the chamber 11, and opposite side portions of the double-pane window 10 are sealed by the window frame.

A bead inlet 13 through which the plurality of beads 1 and air are introduced into the chamber 11 is formed at an upper end of one side portion of the double-pane window 10, for example, on one side of an upper end portion of the window frame of the double-pane window 10.

An air entrance/exit opening 15 through which air enters or exits the chamber 11 is formed in an opening in the upper end portion of the double-pane window 10.

A bead blocking member 17 for the chamber is provided in the air entrance/exit opening 15. The bead blocking member 17 for the chamber has a rectangular plate shape and is coupled to the air entrance/exit opening 15 of the double-pane window 10. A plurality of air passage holes (not illustrated) with a semicircular cross-sectional shape that is smaller than the diameter of the beads 1 are formed through opposite edges of the bead blocking member 17 for the chamber that is brought into close contact with the window-panes of the double-pane window 10. Accordingly, the bead blocking member 17 for the chamber allows only air to enter or exit the chamber 11 through the air passage holes, thereby preventing the beads 1 from being introduced into an air flow pipe 91. Although the air passage holes have been described as having a semicircular cross-sectional shape, the air passage holes, without being limited thereto, may be formed in the shape of one or more slots along the length-wise direction of the bead blocking member 17 for the chamber. Furthermore, the bead blocking member 17 for the chamber may be formed in a mesh shape in which a plurality of passage holes having a diameter smaller than the diameter of the beads 1 are formed.

Meanwhile, a bead outlet 19 through which the plurality of beads 1 and air received in the chamber 11 are discharged is formed on one side of a bottom portion of the window frame of the double-pane window 10.

Furthermore, the double-pane window 10 is equipped with a pressure measurement sensor 21 for measuring the pressure in the chamber 11 and a distance measurement sensor 23 for measuring the distance by which the chamber 11 is filled with the beads. Here, an ultrasonic sensor may be provided as the distance measurement sensor.

The bead discharge means 30*a* serves to discharge the plurality of beads 1 received in the chamber 11 to the bead outlet 19. The bead discharge means 30*a* is provided on an opposite side of the bottom portion of the window frame of the double-pane window 10, for example, on the opposite side to the bead outlet 19. In this embodiment, a chamber air inflow pipe 31 and a chamber air inflow pipe valve 33 are provided as the bead discharge means 30*a*.

The chamber air inflow pipe 31 has a hollow pipe or duct shape. The chamber air inflow pipe 31 connects to the chamber 11 and serves to guide an air flow to introduce outside air into the chamber 11 filled with the beads 1. The chamber air inflow pipe 31 is located on the opposite side to the bead outlet 19 with the chamber 11 therebetween. In this embodiment, the chamber air inflow pipe 31 is illustrated as being connected to a branch pipe 101 via the air flow pipe 91. Without being limited thereto, however, the chamber air inflow pipe 31 may be directly connected to the branch pipe 101, may be connected to an auxiliary air flow pipe 111 that will be described below, may be connected to a separate fan, or may be independently operated.

The chamber air inflow pipe valve 33 that opens or closes the chamber air inflow pipe 31 is provided in the chamber air inflow pipe 31. A flow of air introduced into the chamber 11 along the chamber air inflow pipe 31 may be interrupted by opening or closing the chamber air inflow pipe valve 33.

When the plurality of beads 1 received in the chamber 11 of the double-pane window 10 are discharged into a reservoir 50 through the bead outlet 19, outside air flowing through the chamber air inflow pipe 31 is supplied toward the bead outlet 19 in a bottom area of the chamber 11, and therefore the residual beads 1 on a bottom area on the opposite side to the bead outlet 19 of the chamber 11 are effectively discharged into the reservoir 50 through the bead outlet 19 without stagnating while being obliquely stacked. Accordingly, the beads 1 may be prevented from remaining on the bottom area of the chamber 11.

Meanwhile, as illustrated in FIGS. 5 and 6, an air injection member 35 may be additionally provided, as a bead discharge means 30*b* according to another embodiment, at the bottom of the chamber 11 to inject air flowing through the chamber air inflow pipe 31 toward the bead outlet 19.

As illustrated in FIG. 6, the air injection member 35 has a structure in which a plurality of pipes having different lengths are stacked one above another. For example, the air injection member 35 is formed of one stack in which long pipes having different lengths are disposed close to the bottom of the chamber 11 and short pipes having different lengths are stacked away from the bottom of the chamber 11. Furthermore, the air injection member 35 has a plurality of air injection holes 37 formed through the surface thereof.

Accordingly, outside air introduced into the chamber air inflow pipe 31 has an increasing flow rate while passing through the plurality of pipes having different lengths and is injected toward the bead outlet 19 of the chamber 11 from different positions in the chamber 11, and therefore the plurality of beads 1 received in the chamber 11 are rapidly discharged into the reservoir 50 through the bead outlet 19 without remaining on the bottom area of the chamber 11, by a laminar flow generated by the air injected from the air injection member 35. In particular, the plurality of beads 1 may be effectively discharged toward the bead outlet 19 without remaining on the bottom of the chamber 11, by air injected toward the bottom of the chamber 11 through the plurality of air injection holes 37 formed in the air injection member 35.

FIG. 7 illustrates a bead discharge means 30*c* according to another embodiment. As illustrated, unlike the above-described bead discharge means 30*a* and 30*b*, the bead discharge means 30*c* includes a screw shaft 41 and a screw shaft drive motor 43.

The screw shaft 41 has a helical shape. The screw shaft 41 is provided on the bottom of the chamber 11 so as to be rotatable and is directed toward the bead outlet 19.

The screw shaft drive motor 43 is provided on the exterior of the double-pane window 10 and rotates the screw shaft 41.

Accordingly, when the screw shaft drive motor 43 is operated, the screw shaft 41 rotates while performing a helical motion and delivers the beads 1 located on the bottom area on the opposite side to the bead outlet 19 of the chamber 11 toward the bead outlet 19 by a predetermined amount. Thus, the residual beads 1 in the chamber 11 are effectively discharged into the reservoir 50 through the bead outlet 19 without being obliquely stacked on the bottom area of the chamber 11, and the beads 1 are prevented from remaining on the bottom area of the chamber 11.

In this embodiment, the chamber air inflow pipe 31, the chamber air inflow pipe valve 33, the screw shaft 41, and the screw shaft drive motor 43 are illustrated as being provided together as the bead discharge means. Without being limited thereto, however, only the screw shaft 41 and the screw shaft drive motor 43 may be provided as the bead discharge means.

FIG. 8 illustrates a bead discharge means 30*d* according to another embodiment. As illustrated, unlike the above-described bead discharge means 30*a*, 30*b*, and 30*c*, the bead discharge means 30*d* includes a belt conveyor 45.

The belt conveyor 45 is provided in the bottom area of the chamber 11 and includes a belt 47 that forms a caterpillar, rollers 49 that rotate the belt 47, and a belt drive motor (not illustrated) that rotates the rollers 49.

The beads 1 located on the bottom area on the opposite side to the bead outlet 19 of the chamber 11 are stacked on the belt 47 and delivered toward the bead outlet 19 by the belt conveyor 45 provided in the bottom area of the chamber 11 as described above. Thus, the residual beads 1 in the chamber 11 are effectively discharged into the reservoir 50 through the bead outlet 19 without being obliquely stacked on the bottom area of the chamber 11, and the beads 1 are prevented from remaining on the bottom area of the chamber 11.

In this embodiment, the chamber air inflow pipe 31, the chamber air inflow pipe valve 33, and the belt conveyor 45 are illustrated as being provided together as the bead discharge means. Without being limited thereto, however, only the belt conveyor 45 may be provided as the bead discharge means.

In this embodiment, it has been described that the bead discharge means 30*a*, 30*b*, 30*c*, and 30*d* are applied to the double-pane window insulating system in which a main blowing device 97, which will be described below, suctions air in the chamber 11 to fill the chamber 11 with the plurality of beads 1 stored in the reservoir 50 or discharge the plurality of beads 1 received in the chamber 11 into the reservoir 50. Without being limited thereto, however, the bead discharge means 30*a*, 30*b*, 30*c*, and 30*d* may be applied to a double-pane window insulating system in which the main blowing device 97 forces air into the chamber 11 to fill the chamber 11 with the plurality of beads 1 stored in the reservoir 50 or discharge the plurality of beads 1 received in the chamber 11 into the reservoir 50. That is, the above-described bead discharge means 30*a*, 30*b*, 30*c*, and 30*d* may be applied to various forms of double-pane window insulating systems that suction air in the chamber 11 or force air into the chamber 11 when filling the chamber 11 with the plurality of beads 1 stored in the reservoir 50 or discharging the plurality of beads 1 received in the chamber 11 into the reservoir 50.

Meanwhile, the double-pane window insulating system according to the embodiment of the inventive concept includes the reservoir 50, a bead flow pipe 71, a bead supply pipe 75, a bead discharge pipe 81, an air discharge pipe 85, the air flow pipe 91, a connection pipe 95, and the main blowing device 97.

The reservoir 50 has an enclosed hollow container shape and stores the plurality of beads 1.

A bead blocking member 51 for the reservoir is provided in an upper area inside the reservoir 50. The bead blocking member 51 for the reservoir has a mesh shape having a plurality of passage holes formed therein (not illustrated). The plurality of passage holes formed in the bead blocking member 51 for the reservoir have a diameter smaller than the diameter of the beads 1, and therefore the bead blocking member 51 for the reservoir prevents the plurality of beads 1 introduced into the reservoir 50 from being discharged into the air discharge pipe 85.

Furthermore, a reservoir air inflow pipe 53 is connected to the reservoir 50. The reservoir air inflow pipe 53 has a hollow pipe or duct shape. The reservoir air inflow pipe 53 is connected to a sidewall of the reservoir 50 between the bead blocking member 51 for the reservoir and the air discharge pipe 85 and serves to guide an air flow to introduce outside air into the reservoir 50, more specifically, above the plurality of beads 1 stored in the reservoir 50.

A reservoir air inflow pipe valve 55 that opens or closes the reservoir air inflow pipe 53 is provided in the reservoir air inflow pipe 53. A flow of air introduced into the reservoir 50 along the reservoir air inflow pipe 53 may be interrupted by opening or closing the reservoir air inflow pipe valve 55.

Accordingly, when the chamber 11 is filled with the beads 1, the plurality of beads 1 stored in the reservoir 50 may be effectively discharged from the reservoir 50 without a bottleneck phenomenon, by introducing outside air above the plurality of beads 1 stored in the reservoir 50.

Here, the reservoir air inflow pipe 53 and the reservoir air inflow pipe valve 55 may be optionally provided according to the need.

Furthermore, the reservoir 50 further includes an agitator 61 that stirs the plurality of beads 1 received in the reservoir 50. The agitator 61 includes an impeller 63 having a plurality of blades and a drive motor 65 for the agitator that rotates the impeller 63.

The agitator 61 provided in the reservoir 50 as described above evenly mixes the plurality of beads 1 stored in the reservoir 50, thereby enabling the plurality of beads 1 stored in the reservoir 50 to be effectively discharged from the reservoir 50 without a bottleneck phenomenon, at the same time as preventing the beads 1 from being agglomerated by static electricity generated between the beads 1.

Further, transparent site glass (not illustrated) may be installed on the outside wall of the reservoir 50 along the height direction of the reservoir 50 to allow the amount of beads 1 stored in the reservoir 50 to be visually identified.

Meanwhile, the reservoir 50 is connected with the bead outlet 19 of the double-pane window 10 by the bead flow pipe 71. The bead flow pipe 71 has a hollow pipe or duct shape and guides a flow of the plurality of beads 1.

A bead flow pipe valve 73 that opens or closes the bead flow pipe 71 is provided in the bead flow pipe 71. A flow of the beads 1 along the bead flow pipe 71 may be interrupted by opening or closing the bead flow pipe valve 73.

The bead flow pipe 71 is split into the bead supply pipe 75 and the bead discharge pipe 81.

The bead supply pipe 75 has a hollow pipe or duct shape. The bead supply pipe 75 branches off from the bead flow pipe 71 and is connected to the bead inlet 13. The bead supply pipe 75 serves to guide the plurality of beads 1 discharged from the reservoir 50 into the chamber 11.

A bead supply pipe valve 77 that opens or closes the bead supply pipe 75 is provided in the bead supply pipe 75. A flow of the beads 1 along the bead supply pipe 75 may be interrupted by opening or closing the bead supply pipe valve 77.

The bead discharge pipe 81 has a hollow pipe or duct shape. The bead discharge pipe 75 branches off from the bead flow pipe 71 and is connected to the bead outlet 19. The bead discharge pipe 81 serves to guide the plurality of beads 1 discharged from the chamber 11 into the reservoir 50.

A bead discharge pipe valve 83 that opens or closes the bead discharge pipe 81 is provided in the bead discharge pipe 81. A flow of the beads 1 along the bead discharge pipe 81 may be interrupted by opening or closing the bead discharge pipe valve 83.

The air discharge pipe 85 has a hollow pipe or duct shape. The air discharge pipe 85 is connected to an upper portion of the reservoir 50 and serves to guide a flow of air discharged from the reservoir 50.

An air discharge pipe valve 87 that opens or closes the air discharge pipe 85 is provided in the air discharge pipe 85. A flow of air along the air discharge pipe 85 may be interrupted by opening or closing the air discharge pipe valve 87.

The air flow pipe 91 has a hollow pipe or duct shape. The air flow pipe 91 is connected to the air entrance/exit opening 15 and serves to guide a flow of air flowing through the air flow pipe 91

An air flow pipe valve 93 that opens or closes the air flow pipe 91 is provided in the air flow pipe 91. A flow of air along the air flow pipe 91 may be interrupted by opening or closing the air flow pipe valve 93.

The connection pipe 95 is connected to the air flow pipe 91 and the air discharge pipe 85 so as to be in communication with the air flow pipe 91 and the air discharge pipe 85.

The double-pane window insulating system according to the embodiment of the inventive concept further includes a bead recovery pipe 79*a* and a bead recovery pipe valve 79*b*. The bead recovery pipe 79*a* and the bead recovery pipe valve 79*b* may be optionally provided.

The bead recovery pipe 79*a* has a hollow pipe or duct shape. The bead recovery pipe 79*a* branches off from the bead flow pipe 71 and is connected to an upper area of the reservoir 50. The bead recovery pipe 79*a* serves to guide the plurality of beads 1 discharged from the chamber 11 and flowing through the bead discharge pipe 81, into the upper area of the reservoir 50 via the bead flow pipe 71. Here, although not illustrated, the bead recovery pipe 79*a* may branch off from the bead supply pipe 75 rather than the bead flow pipe 71 and may be connected to the upper area of the reservoir 50.

The bead recovery pipe valve 79*b* is provided in the bead recovery pipe 79*a* and opens or closes the bead recovery pipe 79*a*. A flow of the beads 1 along the bead recovery pipe 79*a* may be interrupted by opening or closing the bead recovery pipe valve 79*b*.

The main blowing device 97 is provided on the connection pipe 95 and suctions air in the chamber 11 through the air flow pipe 91 or suctions air in the chamber 11 through the air discharge pipe 85. Here, a conventional fan, a blower, an air compressor, a pump, or the like may be employed as the main blowing device 97.

Meanwhile, when the main blowing device 97 suctions air in the chamber 11 through the air flow pipe 91, the chamber 11 is filled with the plurality of beads 1 stored in the reservoir 50. At this time, the bead flow pipe valve 73, the bead supply pipe valve 77, and the air flow pipe valve 93 are opened, and the bead discharge pipe valve 83 and the air discharge pipe valve 87 are closed.

When the main blowing device 97 suctions air in the chamber 11 through the air discharge pipe 85, the plurality of beads 1 received in the chamber 11 are discharged from the chamber 11 and stored in the reservoir 50. At this time, the bead flow pipe valve 73, the bead discharge pipe valve 83, and the air discharge pipe valve 87 are opened, and the bead supply pipe valve 77 and the air flow pipe valve 93 are closed.

Furthermore, the double-pane window insulating system according to the embodiment of the inventive concept further includes the branch pipe 101, a branch pipe valve 103, and an auxiliary blowing device 105.

The branch pipe 101 has a hollow pipe or duct shape. The branch pipe 101 branches off from the air flow pipe 91 and serves to guide a flow of air.

The branch pipe valve 103 is provided in the branch pipe 101 and opens or closes the branch pipe 101. A flow of air along the branch pipe 101 is interrupted by opening or closing the branch pipe valve 103.

The auxiliary blowing device 105 is provided on the branch pipe 101 and forces air into the chamber 11 through the branch pipe 101 and the air flow pipe 91. The air introduced into the chamber 11 through the branch pipe 101 and the air flow pipe 91 by the auxiliary blowing device 105 is introduced into the chamber 11 along the windowpanes through the air passage holes of the bead blocking member 17 for the chamber, and the introduced air removes the residual beads 1 attached to the windowpanes by electrostatic forces and flows together with the residual beads 1 to the bead discharge pipe 81 through the bead outlet 19. Here, an air filter 107 for filtering air flowing through the branch pipe 101 may be provided at a front end of the auxiliary blowing device 105.

Furthermore, part of the air flowing along the air flow pipe 91 through the branch pipe 101 by the auxiliary blowing device 105 is introduced into the chamber air inflow pipe 31 and supplied toward the bead outlet 19 provided in the bottom area of the chamber 11, and when the plurality of beads 1 received in the chamber 11 are discharged through the bead outlet 19, the beads 1 are rapidly discharged into the reservoir 50 through the bead outlet 19 without stagnating while being obliquely stacked on the bottom area on the opposite side to the bead outlet 19 of the chamber 11. As a result, the beads 1 may be prevented from remaining on the bottom area of the chamber 11.

Accordingly, when discharging the plurality of beads 1 from the chamber 11 of the double-pane window 10, the double-pane window insulating system minimizes not only the residual beads 1 attached to the windowpanes of the double-pane window 10 but also the residual beads 1 located on the bottom area on the opposite side to the bead outlet 19 of the chamber 11, thereby keeping the windowpanes clean.

Here, a conventional fan, a blower, an air compressor, a pump, or the like may be employed as the auxiliary blowing device 105.

Further, the double-pane window insulating system according to the embodiment of the inventive concept further includes the auxiliary air flow pipe 111 and an auxiliary air flow pipe valve 113.

The auxiliary air flow pipe 111 has a hollow pipe or duct shape. The auxiliary air flow pipe 111 is connected to the branch pipe 101 and the bead flow pipe 71 or a lower end of the reservoir 50 and serves to guide air delivered from the auxiliary blowing device 105 into the bead flow pipe 71 or the lower end of the reservoir 50. A mesh having holes smaller than the beads 1 is installed at the boundary between the auxiliary air flow pipe 111 and the bead flow pipe 71 or the lower end of the reservoir 50 to block a flow of the beads 1.

The auxiliary air flow pipe valve 113 is provided in the auxiliary air flow pipe 111 and opens or closes the auxiliary air flow pipe 111. A flow of air introduced into the bead flow pipe 71 along the auxiliary air flow pipe 111 may be interrupted by opening or closing the auxiliary air flow pipe valve 113.

As described above, air delivered from the auxiliary blowing device 105 is introduced into the bead flow pipe 71 or the lower end of the reservoir 50 through the auxiliary air flow pipe 11*l* to improve the fluidity of the plurality of beads 1 discharged from the reservoir 50 when the chamber 11 is filled with the beads 1. Accordingly, the plurality of beads 1 may effectively flow from the reservoir 50 to the chamber 11 along the bead flow pipe 71.

Here, the auxiliary air flow pipe 111 and the auxiliary air flow pipe valve 113 may be optionally provided according to the need.

Further, the double-pane window insulating system according to the embodiment of the inventive concept further includes an auxiliary bead discharge pipe 115 and an auxiliary bead discharge pipe valve 117.

The auxiliary bead discharge pipe 115 has a hollow pipe or duct shape. The auxiliary bead discharge pipe 115 is connected to the bottom of the chamber 11 and the bead flow pipe 71 and serves to guide a flow of the plurality of beads 1 discharged from the chamber 11 into the reservoir 50.

The auxiliary bead discharge pipe valve 117 is provided in the auxiliary bead discharge pipe 115 and opens or closes the auxiliary bead discharge pipe 115. A flow of the beads 1 introduced into the bead flow pipe 71 along the auxiliary bead discharge pipe 115 may be interrupted by opening or closing the auxiliary bead discharge pipe valve 117.

When the plurality of beads 1 received in the chamber 11 are discharged into the reservoir 50 through the bead outlet 19, the auxiliary bead discharge pipe 115 serves as a bypass discharge line to prevent a bottleneck phenomenon occurring in the bead outlet 19.

Here, the auxiliary bead discharge pipe 115 and the auxiliary bead discharge pipe valve 117 may be optionally provided according to the need.

Furthermore, the double-pane window insulating system according to the embodiment of the inventive concept is equipped with a static-electricity minimizing device for minimizing static electricity generated when the plurality of beads 1 reciprocate between the chamber 11 and the reservoir 50 while colliding with one another.

The static-electricity minimizing device includes an ion generator 121, a temperature controller 123, and a humidity controller 125. The ion generator 121, the temperature controller 123, and the humidity controller 125 are provided on the branch pipe 101. The ion generator 121 ionizes air flowing through the branch pipe 101, the temperature controller 123 controls the temperature of the air flowing through the branch pipe 101, and the humidity controller 125 controls the humidity of the air flowing through the branch pipe 101.

Here, a heater and a cooler may be provided as the temperature controller 123, and a dehumidifier and a humidifier may be provided as the humidity controller 125.

Furthermore, the static-electricity minimizing device includes a temperature measurement sensor 131, a humidity measurement sensor 133, and a static-electricity measurement sensor 135. The temperature measurement sensor 131, the humidity measurement sensor 133, and the static-electricity measurement sensor 135 are provided on the reservoir 50. The temperature measurement sensor 131 measures the temperature in the reservoir 50, the humidity measurement sensor 133 measures the humidity in the reservoir 50, and the static-electricity measurement sensor 135 measures the static electricity between the plurality of beads 1 received in the reservoir 50.

Accordingly, before the plurality of beads 1 stored in the reservoir 50 are discharged into the chamber 11, the static-electricity measurement sensor 135 measures the static electricity of the beads 1 stored in the reservoir 50, and when the static electricity value of the beads 1 is greater than or equal to a reference value, the auxiliary blowing device 105, the ion generator 121, the drive motor 65 of the agitator 61, and the main blowing device 97 are operated under the control of a controller not illustrated. At this time, based on temperature data and humidity data measured by the temperature measurement sensor 131 and the humidity measurement sensor 133 provided on the reservoir 50, the temperature and humidity of air flowing through the branch pipe 101 are controlled to prevent static electricity from being generated between the beads 1 stored in the reservoir 50.

Further, the branch pipe valve 103 is closed at the same time that the auxiliary air flow pipe valve 113 is opened, such that air ionized by the ion generator 121 is supplied into the reservoir 50 through the auxiliary air flow pipe 111.

Furthermore, the air discharge pipe valve 87 is opened, and air introduced into the reservoir 50 is discharged to the outside through the air discharge pipe 85 and the connection pipe 95 by the main blowing device 97. At this time, the air flow pipe valve 93 is closed.

Meanwhile, the beads 1 being stirred by the agitator 61 in the reservoir 50 are mixed with ionized air introduced into the reservoir 50, and thus static electricity is minimized. Further, when the static electricity value measured by the static-electricity measurement sensor 135 is smaller than or equal to the reference value, the auxiliary blowing device 105, the ion generator 121, the drive motor 65 of the agitator 61, and the main blowing device 97 are stopped.

Accordingly, the plurality of beads 1 stored in the reservoir 50 may be stored in a state in which static electricity is minimized.

The static-electricity minimizing device minimizes static electricity generated between the beads 1, thereby preventing the beads 1 from being entangled with one another by the electrostatic force between the beads 1 and reducing a bottleneck phenomenon caused by the beads 1 in the bead flow pipe 71. Furthermore, the static-electricity minimizing device allows the beads 1 to be effectively discharged from the chamber 11 or the reservoir 50, thereby preventing a bottleneck phenomenon. In addition, the static-electricity minimizing device enables the windowpanes to be kept clean, thereby improving user convenience and reduces the power consumption of the main blowing device 97, thereby improving the performance of the entire system.

Meanwhile, the double-pane window insulating system according to the embodiment of the inventive concept may include a rotary feeder 141 for the reservoir that is provided in a lower end portion of the reservoir 50, a rotary feeder 143 for the bead discharge pipe that is provided in a portion where the bead discharge pipe 81 is connected to the bead outlet 19, and a rotary feeder 145 for the auxiliary bead discharge pipe that is provided in a portion where the auxiliary bead discharge pipe 115 is connected to the bottom of the chamber 11.

Accordingly, when the plurality of beads 1 are introduced into or discharged from the reservoir 50, the rotary feeder 141 for the reservoir introduces the plurality of beads 1 into the bead flow pipe 71 or the reservoir 50 by a predetermined amount, thereby reducing a bottleneck phenomenon in a bead exit area of the reservoir 50.

Furthermore, when the plurality of beads 1 received in the chamber 11 are stored in the reservoir 50, the rotary feeder 143 for the bead discharge pipe and the rotary feeder 145 for the auxiliary bead discharge pipe introduce the plurality of beads 1 received in the chamber 11 into the bead discharge pipe 81 and the auxiliary bead discharge pipe 115 by a predetermined amount, thereby reducing a bottleneck phenomenon in a bead exit area of the chamber 11.

In this embodiment, it has been exemplified that the rotary feeder 141 for the reservoir is provided in the lower end portion of the reservoir 50, the rotary feeder 143 for the bead discharge pipe is provided in the portion where the bead discharge pipe 81 is connected to the bead outlet 19, and the rotary feeder 145 for the auxiliary bead discharge pipe is provided in the portion where the auxiliary bead discharge pipe 115 is connected to the bottom of the chamber 11. Without being limited thereto, however, slide gates may be provided instead of the rotary feeders.

Meanwhile, it is effective that the bead flow pipe 71, the bead supply pipe 75, the bead discharge pipe 81, the air discharge pipe 85, the air flow pipe 91, the connection pipe 95, the branch pipe 101, the auxiliary air flow pipe 111, the reservoir air inflow pipe 53, the chamber air inflow pipe 31, and the auxiliary bead discharge pipe 115 are made of a conductive material for the purpose of minimization of static electricity. Furthermore, the bead flow pipe valve 73, the bead supply pipe valve 77, the auxiliary bead discharge pipe valve 117, the air discharge pipe valve 87, the air flow pipe valve 93, the branch pipe valve 103, the auxiliary air flow pipe valve 113, the reservoir air inflow pipe valve 55, the chamber air inflow pipe valve 33, and the auxiliary bead discharge pipe valve 117 may be implemented with a solenoid valve or a motor operated valve that is opened or closed by operation of a motor.

Operations of the above-configured double-pane window insulating system according to the embodiment of the inventive concept will be described below with reference to FIGS. 1 to 3.

First, a process of filling the chamber 11 with the plurality of beads 1 in the state in which, as illustrated in FIG. 1, the reservoir 50 has the plurality of beads 1 stored therein and the chamber 11 of the double-pane window 10 is not filled with the plurality of beads 1 will be described.

The main blowing device 97 is operated in the state in which the bead flow pipe valve 73, the bead supply pipe valve 77, and the air flow pipe valve 93 are open and the bead discharge pipe valve 83, the auxiliary bead discharge pipe valve 117, the air discharge pipe valve 87, and the bead recovery pipe valve **79*b*** are closed.

As illustrated in FIG. 2, the main blowing device 97 operates to suction air existing in the connection pipe 95, the air flow pipe 91, the chamber 11, and the bead supply pipe 75, and the bead flow pipe 71. At this time, air in the reservoir 50 is not suctioned through the air discharge pipe 85 by the main blowing device 97 because the air discharge pipe valve 87 is closed.

Negative pressure is generated in the connection pipe 95, the air flow pipe 91, the chamber 11, the bead supply pipe 75, and the bead flow pipe 71 by the suction operation of the main blowing device 97, and therefore the plurality of beads 1 stored in the reservoir 50 flow along the bead flow pipe 71 and the bead supply pipe 75 and are introduced into an upper area of the chamber 11.

Meanwhile, while or before the plurality of beads 1 are introduced into the chamber 11, the reservoir air inflow pipe valve 55, which is provided in the reservoir air inflow pipe 53, may be opened to introduce outside air having pressure higher than that of the reservoir 50 into the area above the plurality of beads 1 stored in the reservoir 50, thereby effectively discharging the plurality of beads 1 stored in the reservoir 50 from the reservoir 50 without a bottleneck phenomenon.

Furthermore, by opening the auxiliary air flow pipe valve 113, which is provided in the auxiliary air flow pipe 111, and operating the auxiliary blowing device 105 to blow air into the auxiliary air flow pipe 111, the air blown by the auxiliary blowing device 105 may be introduced into the bead flow pipe 71 through the auxiliary air flow pipe 111, thereby improving the fluidity of the plurality of beads 1 discharged from the reservoir 50, and thus the plurality of beads 1 may effectively flow from the reservoir 50 to the chamber 11 along the bead flow pipe 71. At this time, the branch pipe valve 103, which is provided in the branch pipe 101, is closed to prevent the air blown by the auxiliary blowing device 105 from being introduced into the air flow pipe 91 through the branch pipe 101.

The plurality of beads 1 introduced into the chamber 11 freely fall from the upper end portion of the double-pane window 10 toward the lower end portion thereof and fill the entire area of the chamber 11 as illustrated in FIG. 2. At this time, the bead blocking member 17 for the chamber, which is provided in the air entrance/exit opening 15, prevents the plurality of beads 1 in the chamber 11 from being discharged into the air flow pipe 91.

Further, air introduced into the chamber 11 together with the plurality of beads 1 passes through the bead blocking member 17 for the chamber and is discharged to the outside through the air flow pipe 91 by the main blowing device 97.

After the entire area of the chamber 11 is filled with the plurality of beads 1 stored in the reservoir 50, the bead flow pipe valve 73, the bead supply pipe valve 77, and the air flow pipe valve 93 that are in the open state are closed. Simultaneously, the reservoir air inflow pipe valve 55 and the auxiliary air flow pipe valve 113 are closed.

Further, by stopping the main blowing device 97, the chamber 11 of the double-pane window 10 is in the state of being filled with the plurality of beads 1. Accordingly, heat-insulating, light-blocking, and soundproof performances may be improved through the double-pane window 10, and a separate curtain or blind does not need to be additionally installed.

In the case where the bead recovery pipe **79*a* and the bead recovery pipe valve 79*b* in this embodiment are not provided, the chamber 11 may be filled with the plurality of beads 1, by introducing the plurality of beads 1 stored in the reservoir 50 into the upper area of the chamber 11 through the bead flow pipe 71 and the bead supply pipe 75 by operating the main blowing device 97 in the state in which the bead flow pipe valve 73, the bead supply pipe valve 77, and the air flow pipe valve 93 are open and the bead discharge pipe valve 83, the auxiliary bead discharge pipe valve 117, and the air discharge pipe valve 87** are closed.

Hereinafter, a process of discharging the plurality of beads 1 into the reservoir 50 in the state in which the chamber 11 of the double-pane window 10 is filled with the plurality of beads 1 as illustrated in FIG. 2 will be described.

As illustrated in FIG. 3, the main blowing device 97 is operated in the state in which the bead flow pipe valve 73, the bead discharge pipe valve 83, the air discharge pipe valve 87, and the bead recovery pipe valve **79*b* are open and the air flow pipe valve 93** is closed.

The main blowing device 97 operates to suction air existing in the connection pipe 95, the air discharge pipe 85, the reservoir 50, the bead flow pipe 71, the bead recovery pipe **79*a*, the bead supply pipe 75, the bead discharge pipe 81, and the chamber 11. At this time, air in the chamber 11 is not suctioned through the air flow pipe 91 by the main blowing device 97 because the air flow pipe valve 93** is closed.

Negative pressure is generated in the connection pipe 95, the air discharge pipe 85, the reservoir 50, the bead flow pipe 71, the bead recovery pipe **79*a*, the bead discharge pipe 81, and the chamber 11 by the suction operation of the main blowing device 97. Accordingly, some of the beads 1 received in the chamber 11 are introduced into the bottom portion of the reservoir 50 while flowing through the bead discharge pipe 81 along the bead flow pipe 71, and the remaining beads 1 are introduced into the upper portion of the reservoir 50 while flowing through the bead discharge pipe 81 along the bead flow pipe 71 and the bead recovery pipe 79***a*.

Meanwhile, while or before the plurality of beads 1 are introduced into the reservoir 50, the chamber air inflow pipe valve 33 or the branch pipe valve 103 may be opened, and thereafter the auxiliary blowing device 105 may be operated to supply outside air into the chamber 11.

In the case where the bead recovery pipe 79*a* and the bead recovery pipe valve 79*b* in this embodiment are not provided, the plurality of beads 1 may be discharged from the chamber 11, by introducing the beads 1 received in the chamber 11 into the bottom portion of the reservoir 50 through the bead discharge pipe 81 and the bead flow pipe 71 by operating the main blowing device 97 in the state in which the bead flow pipe valve 73, the bead discharge pipe valve 83, and the air discharge pipe valve 87 are open and the air flow pipe valve 93 is closed.

After the plurality of beads 1 are discharged from the chamber 11, some beads 1 are attached to the windowpanes by electrostatic force or remain on the bottom area of the chamber 11.

Accordingly, the branch pipe valve 103 and the chamber air inflow pipe valve 33 are opened, and the auxiliary blowing device 105 is additionally operated. At this time, the auxiliary air flow pipe valve 113, which is provided in the auxiliary air flow pipe 111, is closed to prevent air blown by the auxiliary blowing device 105 from being introduced into the bead flow pipe 71 or the reservoir 50 through the auxiliary air flow pipe 111.

The auxiliary blowing device 105 operates to blow air toward the branch pipe 101, and part of the air blown into the branch pipe 101 passes through the air flow pipe 91 and is introduced into the chamber 11 along the windowpanes through the air passage holes of the bead blocking member 17 for the chamber to remove the residual beads 1 attached to the windowpanes by the electrostatic force. The residual beads 1 flow into the bead discharge pipe 81 through the bead outlet 19.

Furthermore, the rest of the air blown into the branch pipe 101 is introduced into the bottom area of the chamber 11 through the chamber air inflow pipe 31. Outside air having pressure higher than that of the chamber 11 is introduced into the bottom area of the chamber 11 and injected toward the bead outlet 19, and thus the beads 1 are rapidly discharged into the reservoir 50 through the bead outlet 19 without stagnating while being obliquely stacked on the bottom area on the opposite side to the bead outlet 19 of the chamber 11 and are prevented from remaining on the bottom area of the chamber 11.

Accordingly, the amount of beads 1 attached to the windowpanes of the double-pane window 10 and the amount of beads 1 remaining on the bottom area of the chamber 11 are minimized, which makes it possible to keep the windowpanes clean.

Meanwhile, the bead blocking member 51 for the reservoir, which is provided in the reservoir 50, prevents the plurality of beads 1 discharged from the chamber 11 and stored in the reservoir 50 from being discharged into the air discharge pipe 85.

Further, air introduced into the reservoir 50 together with the plurality of beads 1 passes through the bead blocking member 51 for the reservoir and is discharged to the outside through the air discharge pipe 85 and the connection pipe 95 by the main blowing device 97.

After the plurality of beads 1 discharged from the chamber 11 are stored in the reservoir 50, the bead flow pipe valve 73, the bead discharge pipe valve 83, the air discharge pipe valve 87, and the bead recovery pipe valve 79*b* that are in the open state are closed as illustrated in FIG. 1, and the branch pipe valve 103 is closed at the same time.

Further, by stopping the main blowing device 97, the chamber 11 of the double-pane window 10 is in the state in which the plurality of beads 1 are discharged, and the double-pane window 10 lets in light.

FIG. 9 is a view illustrating a configuration of a double-pane window of a double-pane window insulating system according to another embodiment of the inventive concept.

As illustrated in the drawing, unlike in the above-described embodiment, in the double-pane window of the double-pane window insulating system according to the other embodiment of the inventive concept, a bead blocking member 17 for a chamber is provided in a chamber 11 in the cross-sectional shape of "⊂" that is vertically arranged on the opposite side to a bead inlet 13 and a bead outlet 19 and is horizontally arranged on upper and lower sides of the chamber 11.

Accordingly, a plurality of beads 1 received in the chamber 11 may effectively flow into a reservoir 50 through the bead outlet 19 without remaining on the bottom of the chamber 11, by air introduced through air passage holes of the bead blocking member 17 for the chamber.

Meanwhile, the intervals between the air passage holes (not illustrated) that are formed in the bead blocking member 17 for the chamber may be reduced with an approach to a bottom area of the chamber 11. Accordingly, when the plurality of beads 1 received in the chamber 11 are discharged into the reservoir 50, the plurality of beads 1 may be further disturbed and may be prevented from remaining on the bottom of the chamber 11.

In this embodiment, the bead blocking member 17 for the chamber is illustrated as being provided in the chamber 11 in the cross-sectional shape of "⊂". Without being limited thereto, however, the bead blocking member 17 for the chamber may be provided in the chamber 11 in the cross-sectional shape of "|" that is vertically arranged on the opposite side to the bead inlet 13 and the bead outlet 19. Alternatively, the bead blocking member 17 for the chamber may be provided in the chamber 11 in the cross-sectional shape of "⌉" that is vertically arranged on the opposite side to the bead inlet 13 and the bead outlet 19 and is horizontally arranged on an upper side of the chamber 11. In another case, the bead blocking member 17 for the chamber may be provided in the chamber 11 in the cross-sectional shape of "⌊" that is vertically arranged on the opposite side to the bead inlet 13 and the bead outlet 19 and is horizontally arranged on a lower side of the chamber 11.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

EXPLANATION OF SYMBOLS

1: bead

10: double-pane window

11: chamber
13: bead inlet
15: air entrance/exit opening
17: bead blocking member for chamber
19: bead outlet
30*a*,30*b*,30*c*,30*d*: bead discharge means
31: chamber air inflow pipe
35: air injection member
41: screw shaft
43: screw shaft drive motor
45: belt conveyor
50: reservoir
61: agitator
71: bead flow pipe
75: bead supply pipe
79*a*: bead recovery pipe
81: bead discharge pipe
85: air discharge pipe
91: air flow pipe
95: connection pipe
97: main blowing device
101: branch pipe
105: auxiliary blowing device
111: auxiliary air flow pipe
115: auxiliary bead discharge pipe

What is claimed is:

1. A double-pane window insulating system comprising:

a double-pane window including a chamber formed between a pair of windowpanes, a bead inlet through which a plurality of beads and air are introduced into the chamber, a bead outlet through which the plurality of beads and the air received in the chamber are discharged, and an air entrance/exit opening through which air enters or exits the chamber; and a bead discharge means configured to discharge the plurality of beads received in the chamber to the bead outlet.

2. The double-pane window insulating system of claim 1, wherein the bead discharge means includes:

a chamber air inflow pipe provided on the opposite side to the bead outlet so as to connect to the chamber, the chamber air inflow pipe being configured to introduce air into the chamber; and a chamber air inflow pipe valve provided in the chamber air inflow pipe and configured to open or close the chamber air inflow pipe.

3. The double-pane window insulating system of claim 1, wherein the bead discharge means further includes:

an air injection member provided on the bottom of the chamber or in the chamber air inflow pipe and configured to inject air flowing through the chamber air inflow pipe toward the bead outlet, the air injection member including a plurality of pipes that have different lengths and that are stacked one above another.

4. The double-pane window insulating system of claim 1, wherein the bead discharge means further includes:

a rotatable screw shaft having a helical shape and provided on the bottom of the chamber so as to be directed toward the bead outlet; and a screw shaft drive motor configured to rotate the screw shaft.

5. The double-pane window insulating system of claim 1, wherein the bead discharge means further includes:

a belt conveyor provided on the bottom of the chamber to form a caterpillar, the belt conveyor being configured to discharge the plurality of beads received in the chamber toward the bead outlet.

6. The double-pane window insulating system of claim 1, comprising:

a reservoir configured to store the plurality of beads; and a main blowing device configured to suction air in the chamber or force air into the chamber to fill the chamber with the plurality of beads stored in the reservoir or discharge the plurality of beads received in the chamber into the reservoir.

7. The double-pane window insulating system of claim 6, comprising:

a bead flow pipe connected to the reservoir and configured to guide a flow of the plurality of beads;

a bead supply pipe branching off from the bead flow pipe and connected to the bead inlet;

a bead discharge pipe branching off from the bead flow pipe and connected to the bead outlet;

an air discharge pipe connected to the reservoir and configured to guide a flow of air discharged from the reservoir;

an air flow pipe connected to the air entrance/exit opening and configured to guide a flow of air that enters or exits the air entrance/exit opening; and a connection pipe configured to connect to the air flow pipe and the air discharge pipe, wherein the main blowing device is provided on the connection pipe.

8. The double-pane window insulating system of claim 7, further comprising:

a branch pipe branching off from the air flow pipe, the branch pipe being configured to guide a flow of air;

a branch pipe valve provided in the branch pipe and configured to open or close the branch pipe; and an auxiliary blowing device provided on the branch pipe and configured to force air into the chamber through the branch pipe and the air flow pipe.

9. The double-pane window insulating system of claim 2, wherein the chamber air inflow pipe branches off from the air flow pipe or the branch pipe.

10. The double-pane window insulating system of claim 7, comprising:

a bead flow pipe valve provided in the bead flow pipe and configured to open or close the bead flow pipe;

a bead supply pipe valve provided in the bead supply pipe and configured to open or close the bead supply pipe;

a bead discharge pipe valve provided in the bead discharge pipe and configured to open or close the bead discharge pipe;

an air discharge pipe valve provided in the air discharge pipe and configured to open or close the air discharge pipe; and an air flow pipe valve provided in the air flow pipe and configured to open or close the air flow pipe, wherein the bead flow pipe valve and the bead supply pipe valve are opened and the bead discharge pipe valve is closed when the chamber is filled with the plurality of beads from the reservoir, and the bead flow pipe valve and the bead discharge pipe valve are opened and the bead supply pipe valve is closed when the plurality of beads are discharged from the chamber into the reservoir.

11. The double-pane window insulating system of claim 10, further comprising:

a bead recovery pipe branching off from the bead supply pipe or the bead flow pipe, the bead recovery pipe being connected to the reservoir; and a bead recovery pipe valve provided in the bead recovery pipe and configured to open or close the bead recovery pipe, wherein the bead recovery pipe valve is closed when the chamber is filled with the plurality of beads from the reservoir, and the bead recovery pipe valve is opened when the plurality of beads are discharged from the chamber into the reservoir.

12. The double-pane window insulating system of claim 8, further comprising:

an auxiliary air flow pipe connected to the bead flow pipe or a lower end of the reservoir from the branch pipe and configured to guide air blown by the auxiliary blowing device into the bead flow pipe or the lower end of the reservoir; and an auxiliary air flow pipe valve provided in the auxiliary air flow pipe and configured to open or close the auxiliary air flow pipe.

13. The double-pane window insulating system of claim 7, further comprising:

an auxiliary bead discharge pipe through which the plurality of beads discharged from the chamber into the reservoir flow, wherein the auxiliary bead discharge pipe connects the chamber and the bead flow pipe; and an auxiliary bead discharge pipe valve provided in the auxiliary bead discharge pipe and configured to open or close the auxiliary bead discharge pipe.

14. The double-pane window insulating system of claim 8, further comprising:

an ion generator provided on the branch pipe and configured to ionize air flowing through the branch pipe;

a temperature controller provided on the branch pipe and configured to control temperature of the air flowing through the branch pipe; and a humidity controller provided on the branch pipe and configured to control humidity of the air flowing through the branch pipe.

15. The double-pane window insulating system of claim 6, further comprising:

an agitator provided in the reservoir and configured to stir the plurality of beads received in the reservoir.

16. The double-pane window insulating system of claim 6, further comprising:

a temperature measurement sensor configured to measure temperature in the reservoir;

a humidity measurement sensor configured to measure humidity in the reservoir; and a static-electricity measurement sensor configured to measure static electricity between the plurality of beads received in the reservoir.

17. The double-pane window insulating system of claim 1, further comprising:

a bead blocking member for the chamber, the bead blocking member being provided in the chamber to allow only air to enter or exit the chamber, wherein the bead blocking member for the chamber is provided in the chamber in a cross-sectional shape of "|" that is vertically arranged on the opposite side to the bead inlet and the bead outlet, in a cross-sectional shape of "⌉" that is vertically arranged on the opposite side to the bead inlet and the bead outlet and is horizontally arranged on an upper side of the chamber, in a cross-sectional shape of "⌊" that is vertically arranged on the opposite side to the bead inlet and the bead outlet and is horizontally arranged on a lower side of the chamber, or in a cross-sectional shape of "⊂" that is vertically arranged on the opposite side to the bead inlet and the bead outlet and is horizontally arranged on the upper and lower sides of the chamber.

18. The double-pane window insulating system of claim 13, further comprising:

a rotary feeder for the reservoir that is provided in a lower end portion of the reservoir;

a rotary feeder for the bead discharge pipe that is provided in a portion where the bead discharge pipe is connected to the bead outlet; and a rotary feeder for the auxiliary bead discharge pipe that is provided in a portion where the auxiliary bead discharge pipe is connected to the bottom of the chamber.

* * * * *